US005787687A

United States Patent [19]

Mueller et al.

[11] Patent Number: 5,787,687

[45] Date of Patent: Aug. 4, 1998

[54] SERVO-CONTROLLED CONTAINER FILLING AND WEIGHING SYSTEM

[76] Inventors: Martin J. Mueller, 319 Crosswinds Dr., Palm Harbor, Fla. 36483; Michael A. Weigandt, 2205 Webb Ave., Dunedin, Fla. 34698

[21] Appl. No.: 955,575

[22] Filed: Oct. 22, 1997

Related U.S. Application Data

[63] Continuation of Ser. No. 640,601, May 1, 1996, abandoned.

[51] Int. Cl.[6] ..... B65B 1/04

[52] U.S. Cl. ..... 53/473; 53/249; 53/502

[58] Field of Search ..... 53/249, 250, 253, 53/502, 473; 141/159, 160, 129, 148, 172

[56] References Cited

U.S. PATENT DOCUMENTS

| | | | |
|---|---|---|---|
| 3,543,813 | 12/1970 | Creed | 141/148 |
| 3,994,117 | 11/1976 | Kinney | 141/172 |
| 4,404,787 | 9/1983 | Hazelwood | 53/502 |
| 4,705,470 | 11/1987 | Penta | 53/502 |
| 4,971,120 | 11/1990 | Credle, Jr. et al. | 141/129 |
| 5,020,297 | 6/1991 | Borie et al. | 53/253 |
| 5,067,308 | 11/1991 | Ward | 53/250 |
| 5,127,449 | 7/1992 | Mueller et al. . | |
| 5,400,838 | 3/1995 | Schjerven et al. | 53/253 |
| 5,419,009 | 5/1995 | Mueller et al. . | |

FOREIGN PATENT DOCUMENTS

| | | | |
|---|---|---|---|
| 4010951 | 4/1990 | Germany | 141/172 |

*Primary Examiner*—James F. Coan
*Assistant Examiner*—Gene L. Kim
*Attorney, Agent, or Firm*—Rockey, Milnamow & Katz, Ltd.

[57] ABSTRACT

A filling system of a container filling apparatus is configured for selectively, vertically moving an associated container positioned on a conveyor. The apparatus includes a food pump, and a container support platform operatively associated with the conveyor. The support platform is adapted to engage and support the container. A servo-controlled drive motor is configured to move each container positioned on the conveyor, in a controlled, generally vertical direction, perpendicular to the conveying path, toward and away from the food pump. A control system is operatively connected to the motor for providing controlled, programmable movement of the drive motor. Upon commencement of filling of the container with food product, the control means generates and transmits a signal to the motor to selectively position the container in proximity to the food pump and to move the container away from the food pump during filling, in a controlled manner, perpendicular to the conveying path. The servo-controlled drive motor and associated controls can be configured to provide a feedback signal, whereby they function as a load cell for accurate container filling. A servo-controlled drive motor is also preferably employed for effecting indexed movement of the container conveyor in coordination with the vertical movement of each container during filling.

11 Claims, 3 Drawing Sheets

SERVO-CONTROLLED CONTAINER FILLING AND WEIGHING SYSTEM

This is a continuation, of application Ser. No. 08/640,601, now abandoned filed May 1, 1996.

FIELD OF THE INVENTION

This invention pertains to an apparatus for effecting the filling of containers with food product and the like, and more particularly to a servo-controlled system for accurately filling a container with food product being provided continuously from an associated source.

BACKGROUND OF THE INVENTION

In order to effect filling of viscous, flowable food product, such as ice cream, margarine and the like into containers, specialized equipment has been developed which operates to successively move containers through various stages or stations of a filling and sealing apparatus.

In a typical arrangement, the equipment may include an intermittently driven, indexed container conveyor, which operates to convey containers through the various stations for, for example, filling and sealing the container. In such a conveyor, the containers are dispensed onto individual, successive flights or pockets on the conveyor apparatus, and are advanced to successive stations for filling and subsequent sealing and/or lid applying operations. Suitable mechanisms then eject the filled and sealed containers from the apparatus for subsequent packaging, storage and shipment.

It will be appreciated that operation of such container filling and sealing apparatus requires synchronization and coordination of the various stations with the indexed, intermittent advancement of the containers therethrough.

In order to effect the coordination and synchronization of the containers through the various stations of the apparatus, many known conveyors use a system of mechanical drives operating through suitable cams and clutches to intermittently advance the containers. The mechanical drive systems, however, do not permit flexibility in control of the overall packaging process with respect to velocity of the conveyor system, acceleration and deceleration, and dwell or index time of a container at a particular station.

Servo-drive container conveying systems have come into use which provide an advancement in container conveying and filling technology. In such a system, a servo-drive motor, in conjunction with appropriate controls, is used to effect controlled, indexed movement of the conveyor and the containers carried thereby. Such servo-drive systems have increased the flexibility of the overall systems in that dwell times at particular stations, e.g., the filling station, could be varied and controlled, somewhat independently of the overall system. Moreover, the acceleration and deceleration of containers could be more closely controlled to prevent spilling of food product from within the container.

Exemplary of the use of servo-drive systems are those disclosed in U.S. Pat. No. 5,419,099 and U.S. Pat. No. 5,127,449, which patents are commonly assigned herewith, and which are incorporated herein by reference.

Notwithstanding such advances in the design and operation of container filing apparatus, various stations remain controlled by mechanical, i.e., cam and clutch driven systems. One such station or system is that which effects the proper filling into the container, by volume of the food product, from a continuous flow food product stream.

Typically, in known container filling apparatus, food products are packaged and sold by weight which corresponds to a predetermined volume. As such, correlations must be made between the filling times and the weight of the products to assure that the desired amount of food product is packaged in each container. Known container filling apparatus use pneumatic or mechanical systems, such as air cylinders, springs, and the like to support each container as it is filled with food product by the filling apparatus. However, difficulties have been observed in such pneumatic and mechanical systems in assuring accurate filling, as well as operating at high speed.

In one known system, the containers are positioned on a vertically moving platform under the food pump, which platform lowers as each container is filled, with the platform providing resistance to assure complete filling of the container to the desired volume. When filled, the containers drop onto the associated conveyor with the container having received a predetermined volume and weight of food product.

However difficulties arise in that the time necessary for the mechanical systems to function or respond vis-a-vis system controls can be longer than desired, and product weights may undesirably fluctuate. In addition, such systems do not lend themselves to convenient change of product, or container size, thus detracting from versatile use. Additionally, such systems typically must employ scraper-like devices for directing the continuously flowing product from one container into the next as the containers are indexed past the product source.

Thus, there continues to be a need for a versatile and readily adaptable container filling apparatus for effecting filling of containers with the proper amount of food product and for providing flexible control over the presentation of successive containers to continuously flowing food product.

SUMMARY OF THE INVENTION

A container filling apparatus is disclosed which includes a system for selectively, vertically moving an associated container positioned on a conveyor being conveyed in and filled by the container filling apparatus. The system moves and supports the associated container, upward and downward, generally perpendicular to the conveying path, toward and away from a food pump adapted to receive food product therein and to produce a continuous flow stream of food product therefrom to move the food product into the container. Notably, the arrangement for supporting the container during filling includes a servo-controlled drive motor, which can be optionally configured to function as a load cell for enhanced accuracy in filling of containers. Moreover, the container conveyor of the apparatus is preferably driven by a servo-drive motor, thus facilitating efficient operation in coordination with the servo-driven container support.

The container support system includes a container support platform operatively associated with the container conveyor and adapted to engage and support the container. A servo-controlled drive motor is configured to move the container support platform and the container positioned therein, in a controlled, generally vertical direction, perpendicular to the conveying path, toward and away from the food pump.

Control means, operatively connected to the servo-controlled drive motor, provide programmed and controlled movement of the servo-controlled drive motor. Upon commencement of filling of the container with food product, the control means generates and transmits a signal to the servo-controlled drive motor to selectively position the container in proximity to the food pump. During filling, downward movement of the container perpendicular to the conveying path, away from the food pump, is controlled to provide resistance to the flow of the viscous food product, thus assuring proper filling without the undesired creation of voids. When the desired amount of food product is reached, the container is moved downward, away from the food pump, and the associated conveyor indexed so that the flow stream of food product is directed into the next container as the next container is supported by the container platform.

It is within the preview of the present invention that the servo-controlled motor and control system function as a load cell to weigh the container with the food product therein, thus providing enhanced accuracy in filling. It is also contemplated that for some applications the servo-controlled motor, via the control system, can provide a signal to control the filling apparatus to interrupt the flow of food product.

In a current embodiment, the filling and weighing station is positioned in an rotary, indexed filling apparatus. It is contemplated that the rotary conveyor of the apparatus be driven by a servo-controlled motor, thus facilitating programmable filling and conveyance of the containers. In particular, monitoring of the container support platform via the servo-motor drive and associated controls, operates to signal the conveyor drive when the platform moves down to a predetermined position, whereupon the conveyor is indexed to position the next successive container above the support platform for filling from the continuous flowing stream of food product.

Other features and advantages of the present invention will be apparent from the following detailed description, the accompanying drawings, and the appended claims.

DETAILED DESCRIPTION OF THE PREFERRED EMBODIMENTS

Figure 1:
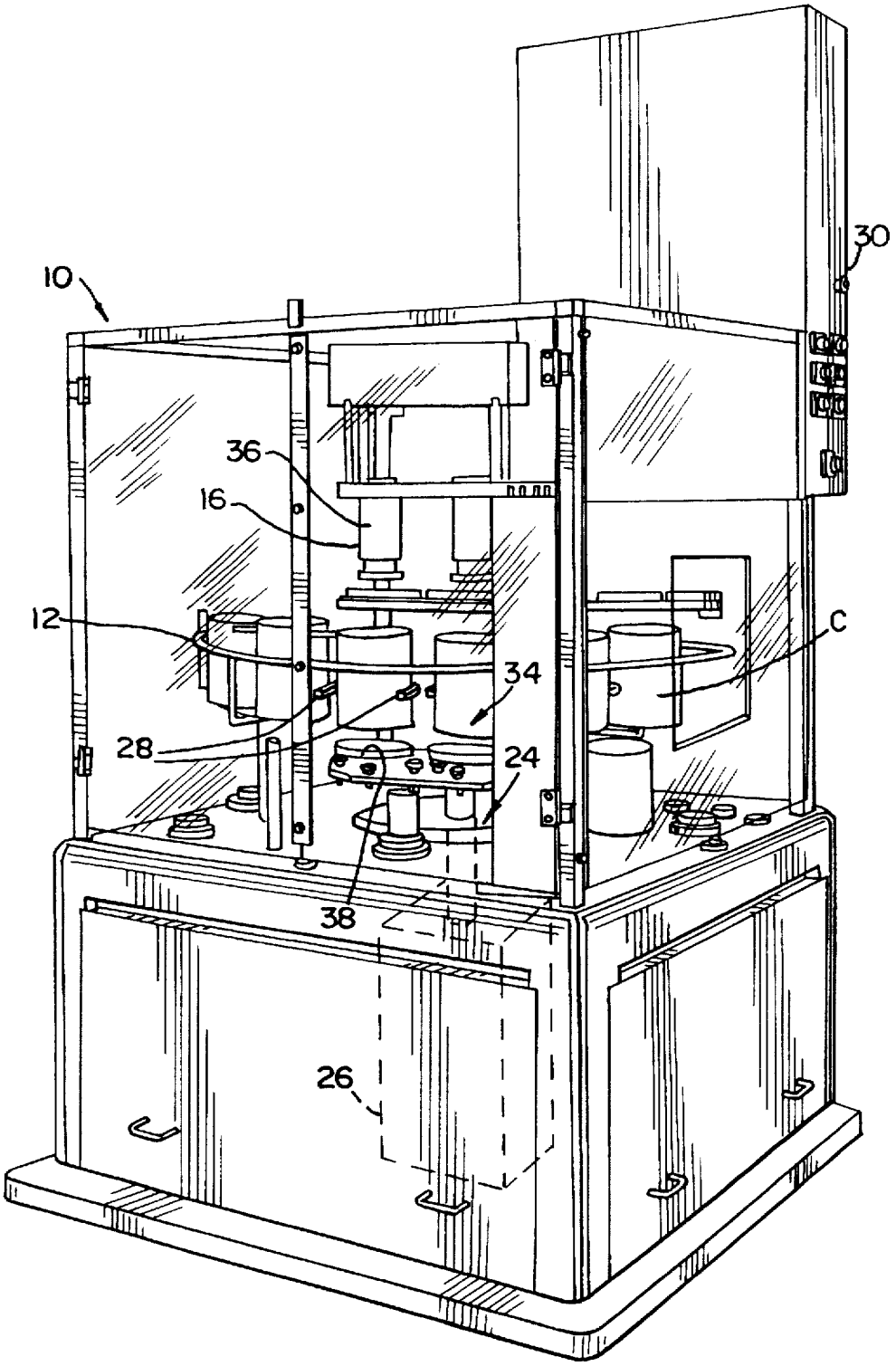
FIG. 1 is a perspective view of an exemplary container conveying and filling apparatus, illustrating a servo-controlled food product filling system in accordance with the principles of the present invention.
Figure 3:
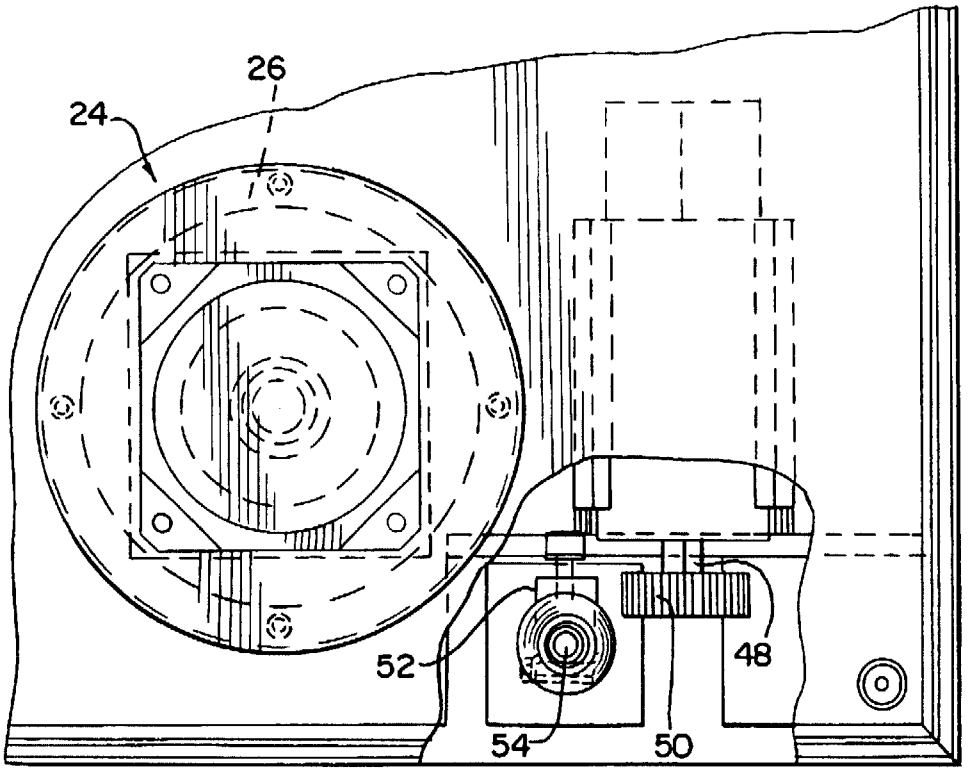
FIG. 3 is a partial plan view of the drive assembly of the food product filling system.
Figure 2:
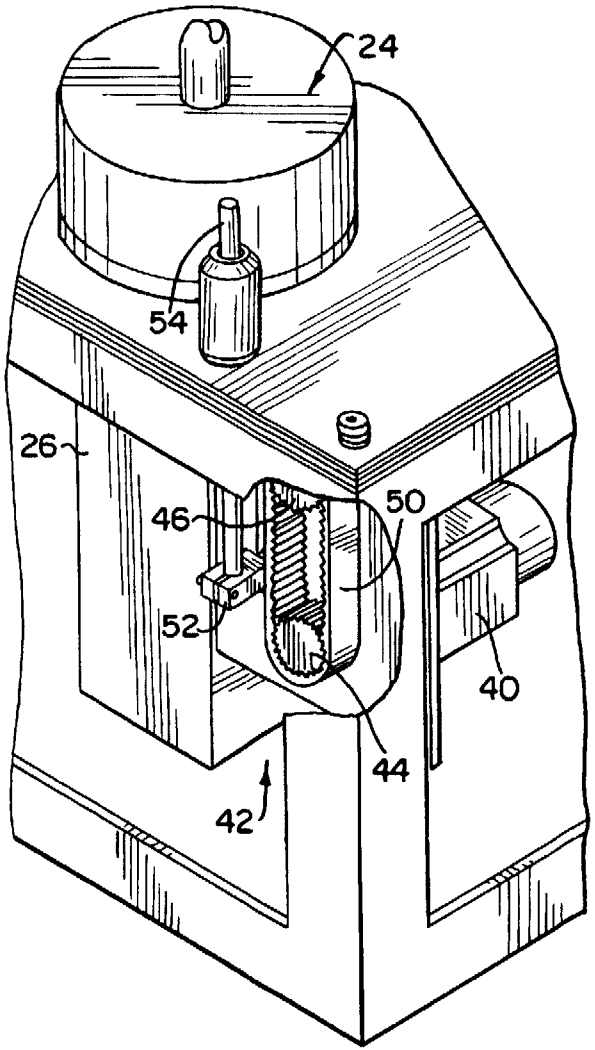
FIG. 2 is a partial perspective view of the conveying and filling apparatus, shown with a portion of the side wall removed for clarity of illustration, showing the drive assembly of the food product filling system.

While the present invention is susceptible of embodiment in various forms, there is shown in the drawings and will hereinafter be described presently a preferred embodiment with the understanding that the present disclosure is to be considered an exemplification of the invention and is not intended to limit the invention to the specific embodiment illustrated.

Referring now to FIG. 1, there is shown an exemplary container conveying and filling apparatus 10, such as that use for filling containers C with ice cream and the like. The exemplary apparatus 10 is of the rotary type, that is, the containers C travel in a generally rotary or circular conveying path during presentation to the various stations of the apparatus 10.

The conveying and filling apparatus 10, includes a conveyor 12 and may include various stations, such as a container C dispensing station (not shown) for dispensing containers which are carried by the conveyor and filled in the apparatus 10. The apparatus may further include a filling station 16 for filling the containers C with product, and a sealing station (not shown) for sealing the containers across the mouth thereof with, for example, a plastic or foil material, which may be heat sealed to the container C to prolong the freshness of the product. The container C may then be presented to a lid applying station (not shown), after which the container C is presented to a chute for discharge from the apparatus 10. The filled container C is then ready for packaging, storage and shipment.

The exemplary conveying and filling apparatus 10 may be servo-controlled and driven. To this end, the apparatus 10 includes a drive system 24 which includes a servo-drive motor 26 operated through a suitable drive assembly to rotatably drive the conveyor 12. The conveyor 12 includes individual flights or pockets 28 for carrying at least one container through the apparatus 10. The servo-drive motor 26 permits the conveyor 12 to be intermittently driven and indexed such that the containers C are sequentially and successively presented to, i.e., stopped at, the various stations of the conveying and filling apparatus 10.

The servo-drive motor 26 is configured for programmable, precise, variable speed operation, control of which is effected by controls 30 of the apparatus 10. The conveyor is preferably configured in accordance with U.S. Pat. No. 5,419,099.

Figure 4:
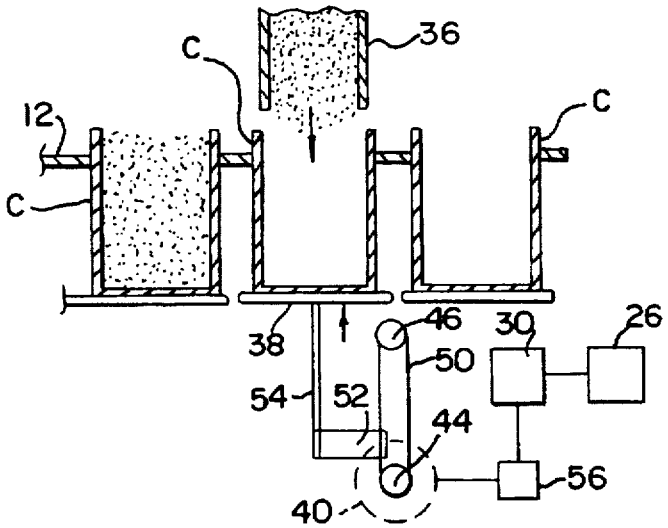
FIGS. 4–6 are schematic views of the filling system of the present invention illustrating a container during a filling cycle.
Figure 5:
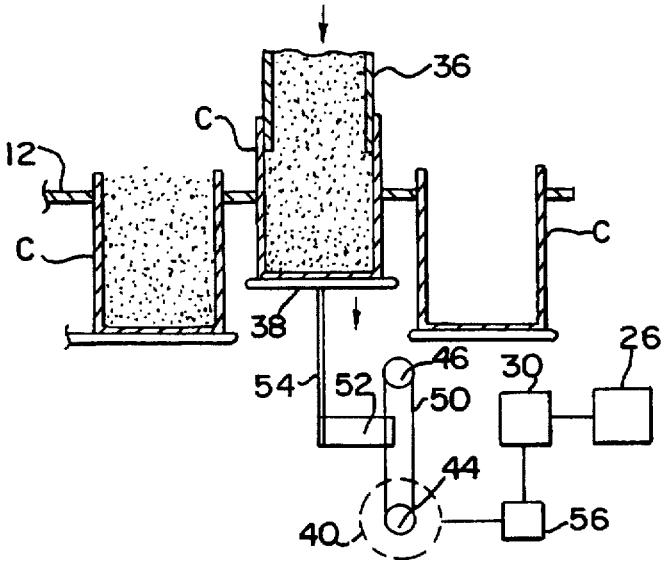
Figure 6:
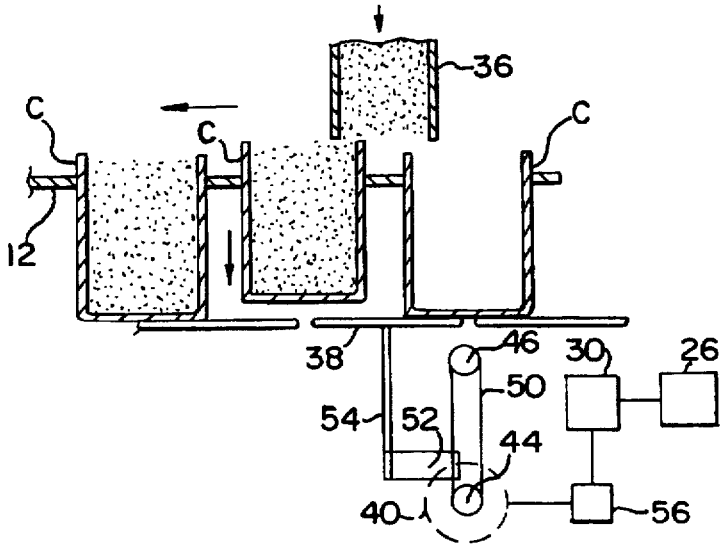

From the dispensing station, the containers are conveyed to the filling station 16 for filling with product. At the filling station 16, the containers are engaged by a product filling system 34 embodying the principles of the present invention, and are positioned below a nozzle of a food pump 36. In the exemplary apparatus 10, as best seen in FIGS. 4–6 the filling system 34 includes a container support platform 38 on which the containers rest, and a servo-drive motor 40 for moving the platform 38 and consequently the containers C in a generally vertical motion, perpendicular to the conveying path. The platform 38 and servo-drive motor 40 are operably connected by a drive mechanism 42.

In a current embodiment, the drive mechanism 42 includes a first drive wheel 44 mounted on an output shaft of the servo-controlled motor 40. A second drive wheel 46 is mounted to the drive mechanism 42 in spaced relation to drive wheel 44. A drive belt 50 extends around both of the drive wheels 44 and 46, and is guided therearound as the servo-drive motor 40 is actuated.

This configuration transfers the rotary motion of the motor 40 into a linear, reciprocating motion of a portion of the belt 50, which linear motion is usable by the station 34, to produce an upward and downward motion of the platform 38.

A connecting member 52 extends from the belt 50 and is operably connected to the platform 38 to effect vertical movement of the platform 38 relative to the apparatus 10, as the servo-drive motor 40 is actuated. The connecting member 52 may be connected to the platform 38 by a shaft 54 which transfers the linear movement of the belt 50 to the shaft 54 and the platform 38. As illustrated in FIGS. 4 and 5, the platform is movable toward and away from the food pump 36.

Motor controls 56 for the servo drive motor 40 which operate the product filling and weighing system 34, are preferably programmable via operative connection to the overall apparatus controls 30. In a current embodiment, the motor controls are of a known, programmable type to facilitate the desired operation of the filling system.

As will be appreciated, use of programmable controls, in conjunction with the servo-drive motor 40, provides a number of distinct advantages for the filling and weighing system 34 over conventional, mechanically driven systems, including cam and clutch type systems. One such advantage is the precise control which can be exercised over the movement, i.e., velocity, acceleration and deceleration, of the motor 40. In effect, the motor 40 can be operated to function like a continuously variable rate spring, thus controlling lowering of a container as it is filled for proper distribution and flow of product within the container.

In operation, a container C is dispensed from the dispensing station and deposited into the support member of the conveyor. The container C is then presented to the filling station 16, where the container C is positioned above the platform 38 and below the food pump 36. During a dwell period in the indexed intermittent movement of the container conveyor, the servo-drive motor 40 is actuated to raise the platform and consequently the container C perpendicular to the conveying path, upward toward the food pump 36.

Referring to FIGS. 4–6, the viscous food product of the type for which the present invention is particularly suited for use typically is delivered from the associated food pump in a continuously flowing stream of product. For example, the product stream may comprise ice cream being continuously delivered from an associated freezer with the nozzle of the food pump generally acting to direct the food product in an extrusion-like fashion.

At the beginning of a fill cycle, the conveyor 12 is quickly indexed to bring an empty container into position beneath the food pump, with the container positioned above the servo motor positioned container support platform 38. The controls of the system signal the servo motor 40 to quickly elevate the platform 38 as food product flows into the container C positioned thereon. During filling, it is important that the platform 38 create sufficient resistance to the downward flow of food product to assure complete filling of the container C without creation of undesired voids. On balance, the platform 38 (controlled by the motor 40) must not exert excessive resistance to flow, or else food product may be forced upwardly about the region between the nozzle and container. Although the nozzle of the food pump typically is sized to fit in close conformance with the interior of each container, some clearance must be provided (typically approximately 1/16 inch) to permit air to escape from within the container as it is filled with food product.

Because of the programmability of the controls which operate the servo motor 40, the rate at which the platform 38 (and the container thereon) is moved upwardly can be precisely controlled, as can the upwardmost position to which the container is moved vertically by the platform. In accordance with such programming, after the initial upward movement of the platform 38 and the container C thereon, upward movement is discontinued (as food product continues to flow into the container), and the servo motor 40 operated so that the platform exerts the desired level of resistance to the flow of product to assure complete filling of the container. Operation of the motor in this fashion may be effected by operation in what is sometimes referred to as "torque mode" in that the weight of the food product acts against torque being created by the motor as the container and platform 38 move downwardly.

As generally illustrated in FIG. 5, the platform 38 continues to move downwardly as the container thereon is filled with food product. During this downward movement, the automatic controls of the system monitor the position of the servo motor 40 (and thus the position of platform 38). When the platform moves downwardly to a predetermined position, the controls of the system operate to signal the servo motor 26 of the container conveyor, whereupon the conveyor quickly indexes the containers relative to the food pump 36. As will be appreciated, the position of the platform 38 at which such indexing is commenced is selected to assure that the container on the downwardly-moving platform clears the nozzle of the food pump, and is preferably selected so that the nozzle of the food pump "wipes" the food product from the upper rim of the container, as generally illustrated in FIG. 6.

Rapid indexing of the container conveyor positions the next successive container beneath the continuously flowing food product, with the container positioned above the container support platform 38. As product flows into the next container, platform 38 is again moved upwardly, and the filling cycle repeated.

One particularly desirable aspect of the servo-drive motor 40 and control 56 arrangement is its programmability for selectively varying the speed, acceleration and deceleration rates of the upward and downward movement of the container C relative to the food pump 36. Specifically, it will be appreciated that different types of food products and the like exhibit differing characteristics, e.g., viscosity, which can affect the manner in which such products can be conveyed and moved, whether in the conveying path or perpendicular thereto. Other characteristics, such as density, can also affect the volume of food product in the container relative to the weight thereof.

Thus, the programmability of the controls 56 for operation of the servo-drive motor permits the filling system 34 as well as the filling station 16 to be operated for optimum efficiency, by selectively varying the rates of upward and downward movement of the container to the maximum values permissible for the particular product, while maintaining accurate weight accounting for each container of food product. The desired versatility achieved by the programmable nature of servo-drive motor 40 is enhanced by the coordinated operation of the programmable servo-drive motor for the container conveyor. The filling apparatus can be readily adapted for handling of differently sized containers, while promoting efficient filling of different food products. Such an arrangement represents a highly desirable advance over mechanical systems employing cams and the like for effecting coordinated operation of various filling machine functions.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A system for selectively, vertically moving an associated container positioned on a conveyor and being conveyed in and filled by an associated container conveying and filling apparatus, the conveyor moving the container in a relatively horizontal, planar conveying path, the apparatus including a food pump having an outlet positionable in operative association with the conveyor, the food pump adapted to receive food product therein and to produce a continuous flow stream of food product therefrom to move the food product into the container, the system comprising:

a container support platform operatively associated with the conveyor and adapted to engage and support the container;

a servo-controlled drive motor configured to move the container platform and the container positioned thereon, in a controlled, generally vertical direction, perpendicular to said conveying path, toward and away from said food pump; and control means operatively connected to said servo-controlled drive motor for providing controlled movement of the servo-controlled drive motor and for operating said servo-controlled drive motor to effectively weigh said container and said food product therein, wherein upon commencement of filling of the container with food product, said control means generates and transmits a signal to said servo-controlled drive motor to selectively position the container in proximity to said food pump and to move the container away from said food pump during filling, in a controlled manner, perpendicular to the conveying path, said control means operating said servo-controlled drive motor to effectively weigh said container and the food product therein and to move said container away from said food pump responsively to the weight of said container and the food product therein to create sufficient resistance to the flow of food product into said container to assure complete filling of the container.

2. The system of claim 1 wherein said control means and said servo-controlled motor include a feedback circuit whereby said apparatus functions as a load cell for weighing the filled container on said container platform.

3. The system of claim 1 wherein said control means are operatively connected to said conveyor so that after said container is filled, said conveyor moves another container into position above said container platform for filling with food product.

4. The system of claim 1 wherein said conveying path is circular.

5. The system of claim 1 further including a drive assembly operably connected to said servo-controlled motor and said container platform for moving said container platform in said vertical direction, perpendicular to said conveying path, said drive assembly including first and second drive wheels in spaced relation one with the other, and a drive belt extending around said drive wheels, one of said drive wheels being operably connected to said servo-controlled motor, said drive assembly further including a connecting member mounted to said belt and extending therefrom, operably connected to said container platform, wherein said servo-drive motor rotates said drive wheel thereby moving said connecting member and said container platform in a generally linear, vertical direction, to selectively, vertically position said container in relation to said food pump.

6. The system of claim 5 wherein said platform is adapted to receive a plurality of containers.

7. The system of claim 1 wherein said apparatus includes another servo-controlled drive motor operatively connected to said control means for driving said conveyor for indexed, intermittent movement, said servo-controlled motor for said conveyor operating after filling of the container to move another container into position above said platform for filling with food product.

8. A container filling apparatus comprising:

a food product pump for providing a continuous flow stream of food product;

a container conveyor for receiving associated containers and serially conveying the containers relative to said food product pump for filling, a servo-controlled drive motor connected to said conveyor for driving said conveyor for indexed, intermittent movement relative to said food pump;

a container support platform positioned in operative association with said conveyor and said food pump for vertically positioning at least one container relative to said food pump during filling of the container with food product from said flow stream;

another servo-controlled drive motor operatively connected to said container platform whereby the vertical movement of said container platform can be selectively controlled during filling of said container to facilitate accurate filling thereof; and control means operatively connected to said servo-controlled drive motors for controlling indexed, intermittent movement of said conveyor, and coordinated vertical movement of said containers during filling of food product from said food product pump, said control means including means for operating the servo-controlled drive motor connected to said container platform in a torque mode to effectively weigh said container and the food product therein to move said container away from said food product pump responsively to the weight of said container and the food product therein to assure complete filling of the container, wherein upon commencement of filling of the container with food product, said control means generates and transmits a signal to said servo-controlled drive motor to selectively position the container in proximity to said food pump and to move the container away from said food pump during filling.

9. A container filling apparatus in accordance with claim 8, wherein said control means and said servo-controlled motor for said container support platform include a feedback circuit to function as a load cell for weighing a filled container on said container platform.

10. A method of filling containers with food product, comprising the steps of:

providing a food product pump, and providing a continuous flow stream of food product from said food product pump;

serially conveying the containers relative to said food product pump for filling;

vertically positioning each one of said containers relative to said food product pump by providing a vertically movable container support platform, and a servo-controlled drive motor operatively connected to said platform for effecting vertical movement thereof; and controlling said vertical positioning of said platform and the one of said containers thereon by operating said servo-controlled drive motor in a torque mode to effectively weigh said one of said containers and the food product therein to move said container away from said food product pump responsively to the weight of said container and the food product therein to assure complete filling of the container, wherein upon commencement of filling of the container with food product, said control means generates and transmits a signal to said servo-controlled drive motor to selectively position the container in proximity to said food pump and to move the container away from said food pump during filling.

11. A method of filling containers in accordance with claim 10, including monitoring feedback from said servo-controlled drive motor for weighing a filled one of said containers to said platform.

* * * * *